United States Patent [19]

Watanabe et al.

[11] Patent Number: 4,858,281

[45] Date of Patent: Aug. 22, 1989

[54] ORNAMENTAL BUTTON

[75] Inventors: Hirokazu Watanabe, Kurobe; Masamichi Shinmi, Tokyo, both of Japan

[73] Assignee: Yoshida Kogyo K. K., Tokyo, Japan

[21] Appl. No.: 181,394

[22] Filed: Apr. 14, 1988

[30] Foreign Application Priority Data

Apr. 14, 1987 [JP] Japan ..... 62-56597[U]

[51] Int. Cl.[4] ..... A44B 1/18

[52] U.S. Cl. ..... 24/113 MP; 24/90 A; 24/113 R

[58] Field of Search ..... 24/113 MP, 113 R, 90 A, 24/95, 453, 49 K, 621; 63/26

[56] References Cited

U.S. PATENT DOCUMENTS

| | | | |
|---|---|---|---|
| 305,620 | 9/1884 | Mayer | 24/113 R |
| 1,382,739 | 6/1921 | Patremio | 24/90 A |
| 1,452,539 | 4/1923 | White | 24/95 |
| 1,610,829 | 12/1926 | Walch | 24/113 R |
| 2,087,074 | 7/1937 | Tucker | 24/113 MP |
| 2,654,927 | 10/1953 | Tansman | 24/113 R |
| 4,035,874 | 7/1977 | Liljendahl | 24/113 MP |

FOREIGN PATENT DOCUMENTS

| | | | |
|---|---|---|---|
| 1557601 | 4/1970 | Fed. Rep. of Germany . | |
| 8303390 | 5/1983 | Fed. Rep. of Germany . | |
| 8530491 | 1/1985 | Fed. Rep. of Germany . | |
| 3342021 | 5/1985 | Fed. Rep. of Germany . | |
| 95221 | 2/1920 | Switzerland | 24/90 A |
| 337350 | 3/1957 | Switzerland . | |
| 610274 | 10/1948 | United Kingdom | 24/113 MP |
| 740235 | 5/1953 | United Kingdom . | |
| 2137476 | 10/1984 | United Kingdom | 24/113 MP |

*Primary Examiner*—Victor N. Sakran

*Attorney, Agent, or Firm*—Hill, Van Santen, Steadman & Simpson

[57] ABSTRACT

A button device has a head member and a back member joined therewith, the head member having a central cavity dimensioned to receive an insert member with a press-fit. The insert member is generally dome-shaped with its peripheral wall upwardly tapered. The cavity is defined by an inner wall initially upwardly flared but deformed to taper when a peripheral ridge is clamped against the insert member by a punch capable of producing a clamping pressure of a bidirectional vector.

5 Claims, 4 Drawing Sheets

ORNAMENTAL BUTTON

BACKGROUND OF THE INVENTION

1. Field of the Invention:

This invention relates to button devices such as snap buttons, tack buttons, eyelets, cuff buttons, neck-tie pins or other ornamental button-like articles to be attached to a garment.

2. Prior Art

There have been proposed many button structures having an ornamental design piece to be inserted into an opening in a support head. Such a design piece or insert generally dome-shaped and made for example of a gem or a colored plastic article was retained in place by an annular flanged rim formed on the peripheral edge of the support head. This attachment was usually done by a punch pressure applied to force the rim against the peripheral wall of the insert, which would often sustain damage particularly if the insert was relatively thin. To avoid this problem, the insert was thickened to provide a cross-sectionally rectangular stem in one prior art as shown in FIG. 8*a* of the accompanying drawings in which the rim 23 of the support head 11 was necessarily folded over the domed surface of the insert 25 by the use of a punch P shown in FIG. 8*b*. This punch P being so shaped could apply a pressure directed predominantly vertically downwardly as shown by the arrow with the result that the head rim would fail to engage the insert with a tight fit which would otherwise be attained in the presence of a positive horizontally directed pressure. Another problem with this type of button device is that the punch would come in direct contact with the insert and would damage the latter if its pressure were too great or would fail to retain the same in place on the head if its pressure were too small, demanding a highly calibrated degree of punch pressure.

SUMMARY OF THE INVENTION

It is therefore the primary object of the present invention to provide a button device which has an insert member and a head member, both members being firmly joined together with a fine press fit and the insert being held harmless against a punch pressure.

According to the invention, there is provided a button device comprising a decorative head member and an insert member retained in a cavity in the head member and having an upwardly tapered peripheral wall firmly embraced with a ridge extending around the cavity.

This and other objects and features of the invention will be more apparent from the following detailed description taken in conjunction with the accompanying drawings. Like reference numerals refer to like or corresponding parts throughout the several views.

DETAILED DESCRIPTION OF THE INVENTION

Figure 1:
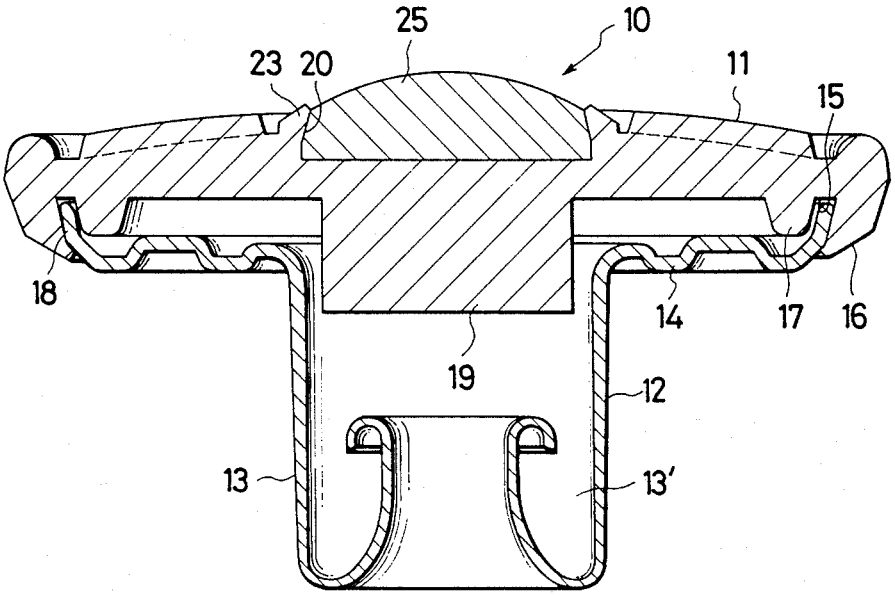
FIG. 1 is a vertical cross-sectional view of a button device embodying the invention.

Referring now to the drawings and FIG. 1 in particular, there is shown a button device generally designated at 10 which comprises an ornamental head member 11 of circular configuration and a back member 12 having a vertical hollow hub portion 13 and a horizontal peripheral flange portion 14.

The head member 11 has in its underside a marginal annular groove 15 defined between an outer peripheral lip 16 and an inner peripheral lug 17, the groove 15 being slightly upwardly flared when having received a complimentarily flared tongue 18 extending from the horizontal flange 14 of the back member 12.

Figure 4:
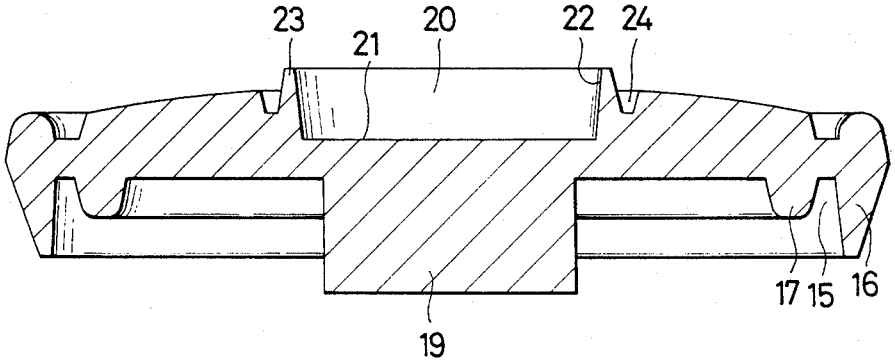
FIG. 4 is a cross-sectional view of a head member shown prior to attachment with the insert.

The head member 11 includes a thick stem 19 extending centrally downwardly into the opening 13' of the hub 13. A circular cavity 20 is formed in the upper surface of the head member 11 centrally above the stem 19, the cavity 20 being defined by a flat bottom wall 21 and an inner peripheral side wall 22 initially slightly upwardly flared as shown in FIG. 4. Integral with the peripheral wall 22 is formed a circular ridge 23 extending slightly above the general upper surface of the head member 11. A circular groove 24 (FIG. 4) is formed in contiguous relation to the ridge 23 so as to render the latter flexible and deformable under punch pressure.

The back member 12 is assembled with the head member 11 by inserting the tongue 18 into the groove 15 defined between the lug 17 and the lip 16, the latter having initially vertically straight inner wall as shown in FIG. 4. With the upwardly flared tongue 18 inserted into the groove 15, the lip 16 is clamped radially inwardly against the lug 17 to retain the tongue 18 firmly in place, at which time the lug 17 serves as a stopper to prevent excessive flexing of the lip 16 which would otherwise result in broken lip 16 particularly if the latter is made for instance of a zinc die-cast.

Figure 2:
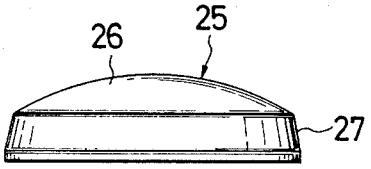
FIG. 2 is a front elevational view of an insert member shown in FIG. 1.

An insert member 25 shown in FIGS. 1 and 2 generally in the form of a dome made for instance of a gem, a plastic material or other decorative piece has a rounded or cross-sectionally arcuate upper surface 26 and a slightly upwardly tapered peripheral wall 27 contiguous to the upper surface 26.

The insert member 25 is placed in the cavity 20 having its peripheral wall 22 initially upwardly flared and its depth slightly greater than the height of the peripheral wall 27 so that the marginal edge of the ridge 23, when press-fitted with the insert member 25, lies in registry with the borderline between the arcuate surface 26 and the peripheral wall 27 thereby presenting an aesthetic appearance of the insert 25 as a whole.

Figure 5:
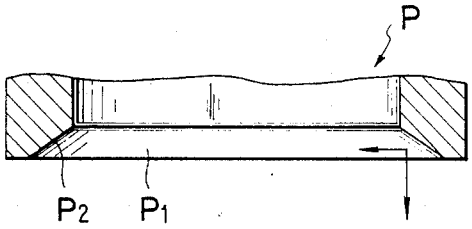
FIG. 5 is a cross-sectional view of a portion of a punch employed for clamping the insert member with the cap.

FIG. 5 schematically illustrates a punch P having a clamping cavity P1 which is shallow enough to avoid direct contact with the insert member 25 and which is defined by an inner wall P2 which is upwardly tapered at an angle to produce a clamping force of a bidirectional vector; namely, vertical and horizontal as indicated by the arrows. This punch P is used in mounting the insert member 25 on the head member 11, when its clamping pressure urges the ridge 23 to bend around and press-fit with the peripheral wall 27 of the insert member 25 in the manner shown in FIG. 1.

Figure 3:
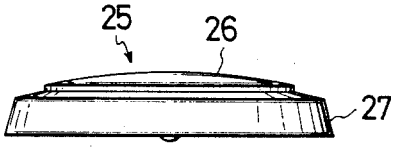
FIG. 3 is a front elevational view of a modified form of insert member.

The configuration of the insert member 25 may be varied somewhat as shown in FIG. 3 which is provided with a stepped upper surface 26a. The upper surface 26a thus stepped from a relatively flat saucer-like display disc which may carry a decorative design, character or the like.

The head member 11 may also carry suitable decorative indicia on its exposed surface.

Figure 6:
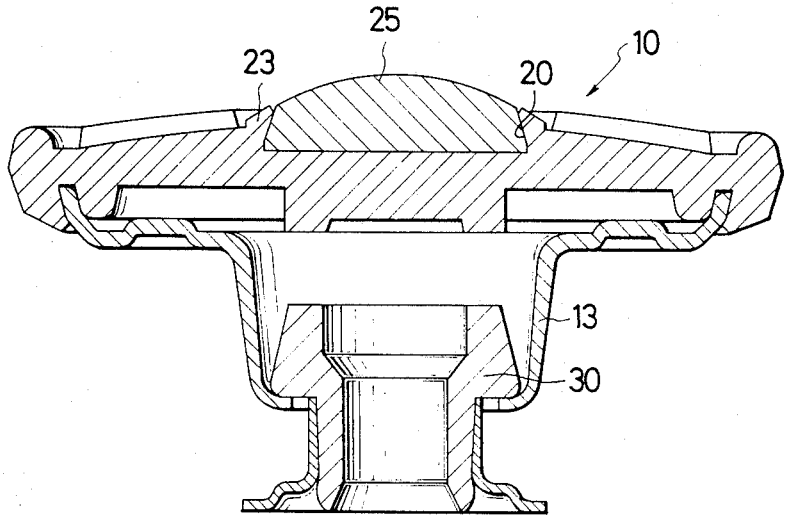
FIG. 6 is a cross-sectional view of the button device of FIG. 1 which is modified to be rockable or tiltable.
Figure 7:
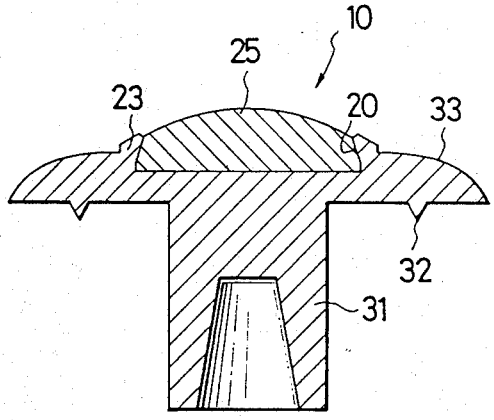
FIG. 7 is a cross-sectional view of a tack or rivet button device embodying the invention.
Figure 8A:
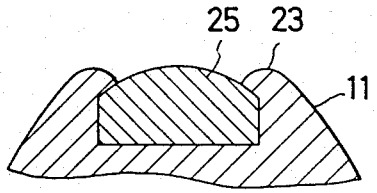
FIG. 8a PRIOR ART
FIG. 8*a* is a cross-sectional view of a portion of a prior art button device.
Figure 8B:
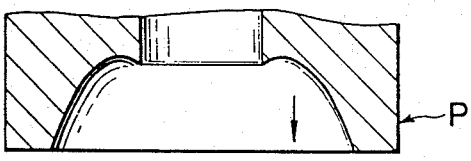
FIG. 8b PRIOR ART
FIG. 8*b* is a cross-sectional view of a punch used for assembling the prior art button device.

FIG. 6 shows the button device 10 of FIG. 1 modified to rock or tilt around a cradle 30 in a manner well known in the art. The button device 10 may also be modified to function as a tack or a rivet having a thrusting shank 31 and a retaining pin 32 in place of the back member 12, as shown in FIG. 7. In the embodiment shown in FIG. 7, the head 33 of the rivet button 10 constitutes a head member and includes a cavity 20 for receiving an insert member 25, and a circular ridge 23 deformable to clinch the insert 25 within the cavity 20. The support member 33 may carry a suitable decorative character on its exposed surface.

Many other modifications and changes may be made without departing from the scope of the appended claims.

What is claimed is:

1. A button device comprising:

(a) a decorative head member having a cavity in its top surface and a ridge on said top surface, said ridge extending around said cavity and defining at least an upper part of said cavity, said head member further having a groove in its top surface, said groove extending around said ridge and being partly defined by said ridge;

(b) an insert member of a rigid material retained in said cavity and having an upwardly tapered peripheral wall firmly embraced with said ridge, said insert member having a generally dome-like shape including an arcuate upper surface contiguous to said peripheral wall, said ridge having a marginal edge lying in registry with the borderline between said upper surface and said peripheral wall.

2. A button device according to claim 1, said upper surface of said insert member being stepped.

3. A button device according to claim 1, further including a shank extending integrally perpendicularly from the underside of said head member.

4. A button device comprising:

(a) a decorative head member having a cavity in its top surface and a ridge on said top surface, said ridge extending around said cavity and defining at least an upper part of said cavity;

(b) an insert member of a rigid material retained in said cavity and having an upwardly tapered peripheral wall firmly embraced with said ridge, said insert member having a generally dome-like shape including an arcuate upper surface contiguous to said peripheral wall, said ridge having a marginal edge lying in registry with the borderline between said upper surface and said peripheral wall; and (c) a back member disposed below and joined with said head member, said back member having a vertical hollow hub, said head member including a thick stem on its underside extending into said hollow hub;

said head member having in its underside a marginal annular groove defined between an outer peripheral lip and an inner peripheral lug, said back member having a horizontal flange integral with said vertical hollow hub and including an outer marginal tongue received in said annular groove and firmly gripped by and between said lip and said lug.

5. A button device according to claim 4, said cavity being disposed above said stem.

* * * * *